US008864187B2

(12) United States Patent
Jitsuishi et al.

(10) Patent No.: US 8,864,187 B2
(45) Date of Patent: Oct. 21, 2014

(54) VEHICLE DOOR OPENING AND CLOSING SYSTEM

(75) Inventors: Norifumi Jitsuishi, Makinohara (JP); Hironori Matsumoto, Makinohara (JP); Takahiro Kan, Kariya (JP)

(73) Assignees: Yazaki Corporation, Tokyo (JP); Toyota Auto Body Co., Ltd., Aichi (JP)

( * ) Notice: Subject to any disclaimer, the term of this patent is extended or adjusted under 35 U.S.C. 154(b) by 607 days.

(21) Appl. No.: 12/343,077

(22) Filed: Dec. 23, 2008

(65) Prior Publication Data

US 2009/0173006 A1 Jul. 9, 2009

(30) Foreign Application Priority Data

Dec. 28, 2007 (JP) ..... P2007-341196

(51) Int. Cl.

| | |
|---|---|
| ***E05C 3/06*** | (2006.01) |
| ***E05F 15/00*** | (2006.01) |
| *E05F 15/20* | (2006.01) |

(52) U.S. Cl.

CPC ..... *E05F 15/0004* (2013.01); *E05F 15/2092* (2013.01); *E05Y 2400/814* (2013.01); *E05Y 2400/59* (2013.01); *E05F 15/00* (2013.01); *E05Y 2900/546* (2013.01); *E05Y 2900/544* (2013.01); *Y10S 292/23* (2013.01)

USPC ..... 292/201; 292/216; 292/DIG. 23

(58) Field of Classification Search

CPC ..... E05B 81/14; E05B 85/26; E05B 81/26; A61B 5/0022

USPC ..... 292/201, 216, DIG. 23, 336.3; 340/815.4

See application file for complete search history.

(56) References Cited

U.S. PATENT DOCUMENTS

| | | | | |
|---|---|---|---|---|
| 5,543,778 | A * | 8/1996 | Stouffer | 340/539.14 |
| 5,551,190 | A | 9/1996 | Yamagishi et al. | |
| 6,178,699 | B1 | 1/2001 | Kawanobe et al. | |
| 6,279,361 | B1 * | 8/2001 | Baukholt et al. | 70/279.1 |
| 6,733,052 | B2 * | 5/2004 | Perkins et al. | 292/201 |
| 6,776,442 | B2 * | 8/2004 | Edgar | 292/216 |

(Continued)

FOREIGN PATENT DOCUMENTS

| | | |
|---|---|---|
| JP | 2707040 B2 | 10/1997 |
| JP | 2002-250163 | 9/2002 |

(Continued)

OTHER PUBLICATIONS

Notification of Reasons for Refusal, drafted May 14, 2012, for Japanese Patent Application No. 2007-341196 (12 pages).

*Primary Examiner* — Kristina Fulton
*Assistant Examiner* — Nathan Cumar
(74) *Attorney, Agent, or Firm* — Finnegan, Henderson, Farabow, Garrett & Dunner, L.L.P.

(57) ABSTRACT

The invention provides a vehicle door opening and closing system for making a notice before opening and closing a door by using a motor to enhance the safety. The inventive is a door opening and closing system mounted on a vehicle including a controller generating and sending a first instruction and a second instruction, a motor controlled by the controller so as to open or close the door and an announce mechanism controlled by the controller. The first instruction instructs the motor to drive after a predetermined wait time from the generation of the first instruction; and the second instruction instructs the announce mechanism to announce generation of the first instruction for a predetermined notice time before starting to drive the motor.

4 Claims, 15 Drawing Sheets

(56) References Cited

U.S. PATENT DOCUMENTS

| | | | | |
|---|---|---|---|---|
| 7,543,861 | B2 * | 6/2009 | Dupont et al. | 292/216 |
| 8,444,189 | B2 * | 5/2013 | Jitsuishi et al. | 292/201 |
| 2004/0227356 | A1 * | 11/2004 | Koike et al. | 292/216 |
| 2005/0127685 | A1 * | 6/2005 | Spurr et al. | 292/201 |
| 2006/0181401 | A1 * | 8/2006 | Martin | 340/506 |
| 2006/0227001 | A1 * | 10/2006 | Petricoin et al. | 340/815.4 |
| 2008/0073917 | A1 * | 3/2008 | Ciavaglia et al. | 292/201 |

FOREIGN PATENT DOCUMENTS

| | | | |
|---|---|---|---|
| JP | 3630008 | B2 | 12/2004 |
| JP | 3656788 | B2 | 3/2005 |
| JP | 2005-194786 | A | 7/2005 |

* cited by examiner

VEHICLE DOOR OPENING AND CLOSING SYSTEM

BACKGROUND

The present invention relates to a vehicle door opening and closing system.

In the related art, a vehicle 1 such as a wagon or a minivan include a flip-up type back door 2 shown in FIG. 17(A) or a back door composed of a flip-up type back door (upper door) 2 and a flip-down type lower door 3 shown in FIG. 17(B).

For the vehicle 1 shown in FIG. 17(B), the upper door 2 is able to be opened and closed while the lower door 3 is closed. The lower door 3 is able to be opened and closed while the upper door 2 is open. To open the lower door 3, as shown in FIG. 18, after unlock the lock mechanism 40 on both sides of the closed lower door 3 by operating the release lever 50 of the lower door 3, the lower door 3 is manually opened. To close the lower door 3, the lower door 3 is manually closed and pushed so as to lock the lock mechanism 40.

The above back doors are manually opened or closed without exception. There is known an automatic door opening and closing method using a motor for locking and unlocking the lock mechanism of the back door of a vehicle by way of driving control by a single motor. (JP-A-2002-250163)

SUMMARY OF THE INVENTION

The door opening and closing method requires a force to operate a release lever and a force to push in a lower door to lock a lock mechanism. Therefore users are imposed on a heavy load. While the lock state is imperfect with the door pushed in halfway, the user is unlikely to perceive the situation. And also, as the opening and closing method requires manual operation to users, there is less sense of luxury and high product quality.

In the above described door opening and closing method, a single motor driving control is used. As the size of the door is increased, a plurality of motors is required. This results in problems of poor quality such as jerky movement of the door and asynchronous motor driving sound.

In addition, in the door opening and closing method describe above, there is a possibility of unexpected door opening and closing operation caused by an unintended operation or a circumstance around the vehicle etc, for example, the vehicle condition being parked on an inclined space. This unexpected door opening and closing operation makes the user's body and baggage caught between the door and the vehicle. In particular, the driving force is stronger when a plurality of motors are used for automatic door opening and closing so that a more serious accident could occur than when a single motor is used for opening and closing the vehicle door.

The invention is accomplished in view of the above problems. An object of the invention is to provide a vehicle door opening and closing system for making a notice before opening and closing a door by using a motor to enhance the safety.

The first aspect of the present invention is a door opening and closing system mounted on a vehicle including a controller generating and sending a first instruction and a second instruction, a motor controlled by the controller to open and close the door, and an announce mechanism controlled by the controller. The first instruction instructs the motor to drive after a predetermined wait time from generation of the first instruction and the second instruction instructs the announce mechanism to announce generation of the first instruction for a predetermined notice time before starting to drive the motor.

Preferably, the wait time includes the notice time and a predetermined recognition time. Further preferably, the controller generates and sends a third instruction instructing the motor to drive after the recognition time.

The second aspect of the present invention is a door opening and closing system mounted on a vehicle includes a controller generating and sending a first instruction and a second instruction and an announce mechanism controlled by the controller and a door opening and closing device controlled by the controller. The door opening and closing device includes a latch mechanism changing states including at least a full latch state and a half latch state, a motor driving the switching of the latch mechanism and a latch switch detecting the states of the latch mechanism. The first instruction instructs the motor so that the latch mechanism changes from the half latch state to the full latch state after a predetermined wait time from when the half latch state is detected by the latch switch and the second instruction instructs the announce mechanism so as to provide a signal during a predetermined notice time in order to inform the detection of the half latch state.

The third aspect of the present invention according to the first and second aspects of the invention is the door opening and closing system described above further comprising a plurality of the door opening and closing device. The plurality of the door opening and closing devices are spontaneously controlled by the controller.

The fourth aspect of the present invention according to the third aspect is door opening and closing system described above in which the latch switch includes a half latch switch and a full latch switch. The half latch switch changes from an ON state to a OFF state when the latch mechanism changes into the half latch state and the full latch switch changes from an OFF state to a ON state when the latch mechanism changes into the full latch state.

The fifth aspect of the present invention according to the forth aspect is the door opening and closing system described above in which a predetermined notice determination time threshold value is further installed in the controller and the controller stops the motor driving if the threshold value is smaller than a time between when the half latch switch changes from the ON state to the OFF state and when the full latch switch changes from the OFF state to the ON state during closing operation. Preferably, the controller drives the motor so as to open the door after the motor stopping.

According to the first aspect of the invention, driving of a motor is started when a predetermined wait time has elapsed from an indication to start driving of the motor in case a vehicle door is set into the closed state from the open state. Announcing means issues a notice signal for informing start of driving during the wait time. Thus, the user is informed of the start of operation before automatic door opening and closing operation thus preventing possible pinching and assuring the safety of the user. The wait time includes a notice time for issuing the notice signal at the start of driving of the motor and a recognition time for letting the user recognize completion of the notice after the end of the notice time. This allows the user to fully recognize the notice signal and enhances the safety of the user.

According to the second aspect of the invention, control is made to make an instruction to start driving of a motor when the latch state detection means of the door opening and closing device has detected a half latch state, to start driving of the motor when a predetermined wait time has elapsed from the indication to start driving, and to control the latch mechanism into the full latch state from the half latch state in case the vehicle door is set into the closed state from the open state.

Announcing means issues a notice signal for informing start of driving during the wait time. Thus, the user is informed of the start of operation before automatic door opening and closing operation thus preventing possible pinching and assuring the safety of the user.

According to the third and forth aspect of the invention, control is made to make an instruction to start driving the motor when all of the latch state detection means of a plurality of door opening and closing devices have detected the half latch state, to start synchronous driving of all the motors of the plurality of door opening and closing devices when a predetermined wait time has elapsed from the indication to start driving, and to control all of the latch mechanisms into the full latch state from the half latch state in case the vehicle door is set into the closed state from the open state. Announcing means issues a notice signal for informing start of driving during the wait time. Thus, the user is informed of the start of operation before automatic door opening and closing operation thus preventing possible pinching and assuring the safety of the user.

The fifth aspect of the invention has pinching determination means for determining presence of pinching in case the time that has elapsed from when driving of the motor was started to when the vehicle door is fully closed is longer than a pinching determination threshold time. The control means stops driving of the motor based on the determination of the pinching determination means, which further enhances the safety.

According to the fifth aspect of the invention, the control means performs driving control of the motor after the driving is stopped until the vehicle door returns to the full-open state. This ensures recovery to a safe state in the presence of pinching.

DETAIL DESCRIPTION OF EMBODIMENTS

Embodiments of the invention are described referring to figures.

First Embodiment

Figure 1:
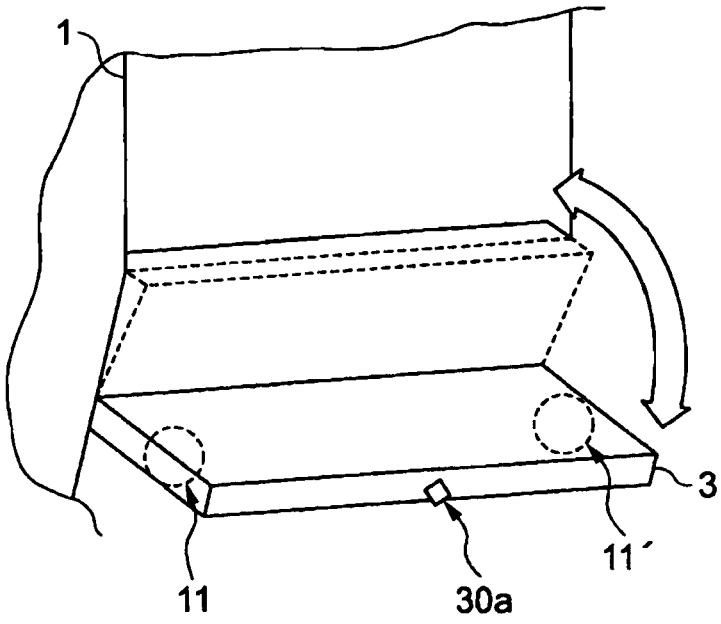
FIG. 1 It is a block diagram showing the key parts of a vehicle to which a vehicle door opening and closing system according to the first embodiment of the invention is applied (first embodiment).

A vehicle door opening and closing system according to the first embodiment of the invention is used to control opening and closing of a lower door 3 of a back door of a vehicle 1 having a flip-up type upper door and a flip-down type lower door for example shown in FIG. 1. That is, the vehicle door opening and closing system according to the invention includes two door opening and closing devices 11, 11' respectively arranged inside both sides of the lower door 3 and a handle switch button 30*a* arranged at the tip of the lower door 3.

The lower door 3 is opened and closed by two ways. The first way is a manual opening and closing operation by the user. The second way is an automatic opening and closing control by the door opening and closing device 11, 11' with the handle switch button 30*a*. The upper door is set to be able to be opened and closed by another door opening and closing device arranged inside the upper door when the lower door 3 is in a full closed state (a full latch state) as described later. Because the door opening and closing device arranged inside the upper door is not included in the present invention, the detail description of the door opening and closing device arranged inside the upper door is omitted.

The two door opening and closing devices 11, 11' constituting the vehicle door opening and closing system respectively have almost the same mechanical configuration as that in JP-2002-250163. Therefore, the single door opening and closing device 11 is described using some of the description and figures in JP-2002-250163.

Figure 2:
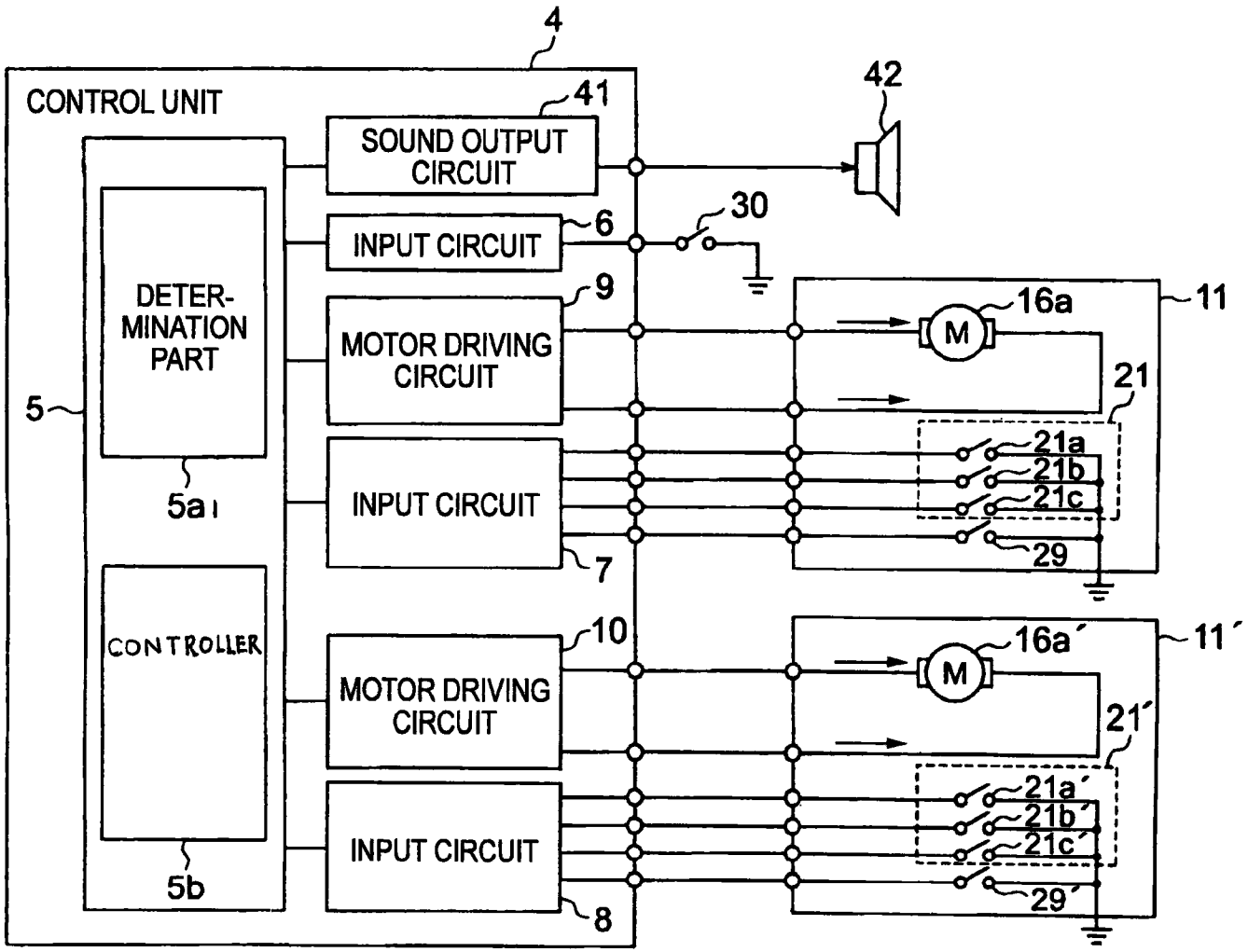
FIG. 2 It is a block diagram showing the electric configuration of the vehicle door opening and closing system (first embodiment).

FIG. 2 is a block diagram showing the electric configuration of the vehicle door opening and closing system according to the first embodiment of the invention. As shown in FIG. 2, the vehicle door opening and closing system comprises door opening and closing devices 11, 11' of the same configuration, a control unit 4, a handle switch 30, and a loudspeaker 42.

The door opening and closing device 11 includes a motor 16*a*, a latch state detection switch (hereinafter referred to as a latch switch) 21, and a neutral switch 29. The latch switch 21 includes a half latch switch 21*a*, a full latch switch 21*b* and a courtesy switch 21*c*.

The door opening and closing device 11' includes a motor 16*a'*, a latch state detection switch (hereinafter referred to as a latch switch) 21', and a neutral switch 29'. The latch switch 21' includes a half latch switch 21*a'*, a full latch switch 21*b'* and a courtesy switch 21*c'*.

The control unit 4 includes a control and determination part 5 and input circuits 6, 7, 8, motor driving circuits 9, 10 and a sound output circuit 41 connected to the control and determination part 5. The control and determination part 5 includes a determination part 5*a* and a controller 5*b*. The handle switch 30 is connected to the input circuit 6.

The motor 16*a* of the door opening and closing device 11 is connected to the motor driving circuit 9. The latch switch 21 and the neutral switch 29 are connected to the input circuit 7. The motor 16*a'* of the door opening and closing device 11' is connected to the motor driving circuit 10. The latch switch 21' and the neutral switch 29' are connected to the input circuit 8. The control unit 4 may be configured by a microcomputer for example.

Next, the mechanical configuration of the door opening and closing device 11 is described. While the detailed description of the configuration of the door opening and closing device 11' of the same configuration is omitted, a common component with the door opening and closing device 11 will be described with a prime (') appended to the sign of a component of the door opening and closing device 11.

Figure 3:
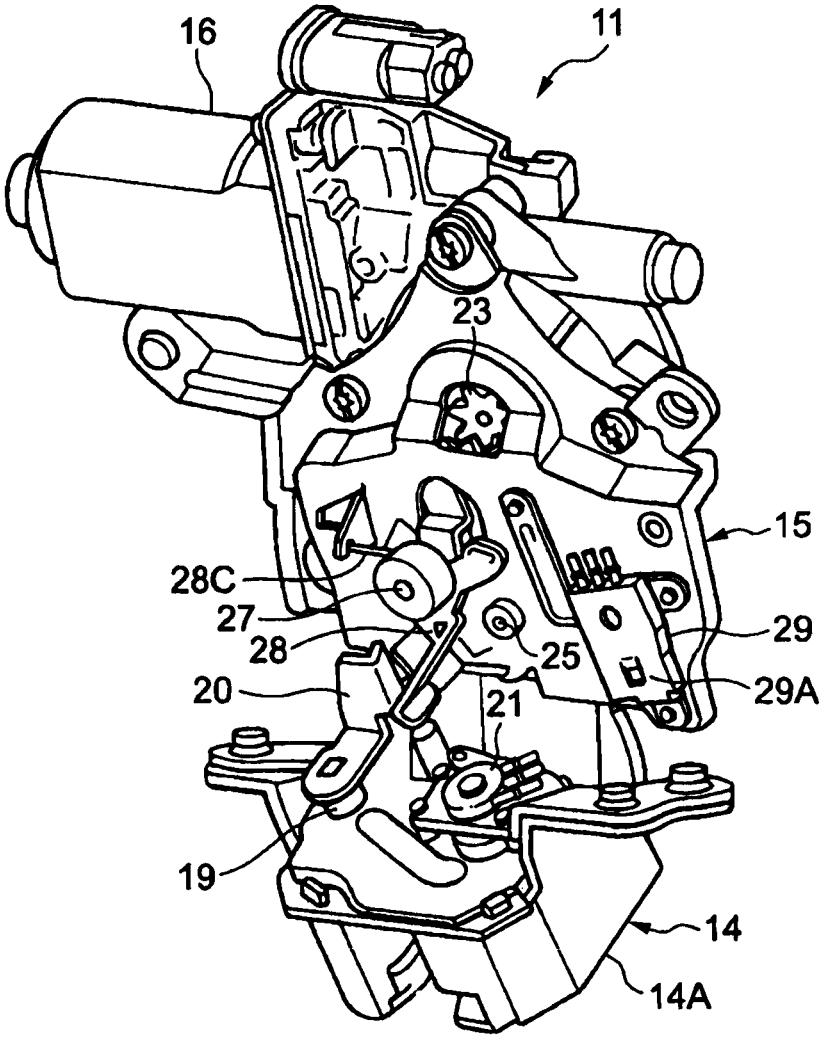
FIG. 3 It is a general perspective view of the mechanical configuration of a door opening and closing device of the vehicle door opening and closing system (first embodiment).

FIG. 3 is a general perspective view of the door opening and closing device 11. The door opening and closing device 11 includes a latch mechanism 14 including a latch 13 to be engaged with a striker 12 (shown in FIG. 5 only) as an engaging member fixed to a vehicle body opening closed by the lower door 3. The door opening and closing device 11 includes an operation mechanism 15 for operating the latch mechanism 14 and a motor part 16 as an actuator capable of driving the operation mechanism 15. The motor part 16 includes a motor 16*a* subjected to driving control by the control unit 4.

FIGS. 4 to 8 show the operating state of the latch mechanism 14, the operation mechanism 15 and the motor part 16 by using only the moving members thereof. As shown in FIGS. 4 to 8, the latch mechanism 14 includes a latch 13 and an engaging piece 17 to be engaged with the latch 13.

The latch 13 is rotatably supported by the housing 14A (shown in FIG. 3 only) of the latch mechanism 14 with a latch spindle (not shown) penetrating through a hole 13A formed in the latch 13. The latch 13 includes a U-shaped groove 13C opened on its outer perimeter surface 13B. The striker 12 is introduced into the U-shaped groove 13C with movement of the lower door by manual force or the like. First and second engaging protrusions 13D and 13E are formed on the latch 13 so as to protrude outward from the outer perimeter surface 13B. The first and the second engaging protrusions 13D and 13E are formed to be engaged with the engaging piece 17.

A latch lever 18 is fixed onto the latch 13. The latch spindle penetrates through a hole 18A as well formed in the latch lever 18. The latch lever 18 has an arm part 18B extending away from the rotational center of the latch 13. At the tip of the arm part 18B is erected an engaging pin 18C.

The engaging piece 17 is fixed to an engaging piece spindle 19 arranged parallel to the latch spindle and rotatably supported by the housing 14A. AT the upper end of the engaging piece spindle 19, an engaging piece lever 20 is fixed.

Figure 5:
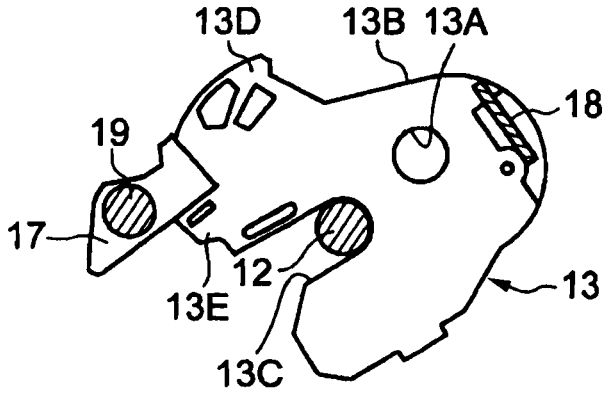
FIG. 5 It is a plan view of the key parts of the latch mechanism of the door opening and closing device (first embodiment).

FIG. 5 is a plan view of the latch 13 and the engaging piece 17. The latch 13 is tugged in counterclockwise direction in FIG. 5 by a spring (not shown). The engaging piece 17 is tugged also in counterclockwise direction in FIG. 5 by a spring (not shown).

When the first engaging protrusion 13D of the latch 13 and the engaging piece 17 are placed in an engaging state (FIG. 5) with the striker 12 arranged in the U-shaped groove 13C, the lower door is half closed. This condition is defined as a half latch state.

When the second engaging protrusion 13E of the latch 13 and the engaging piece 17 are placed in an engaging state with the striker 12 arranged in the U-shaped groove 13C, the lower door is fully closed. This condition is defined as a full latch state.

When the engaging piece 17 is rotated counterclockwise to release the engagement between the engaging piece 17 and the latch 13 in the half latch state or full latch state, the latch 13 is rotated by the restoring force of the spring and abuts against a stopper (not shown) and is held in an open state. When the latch 13 is in the open state, introduce and removal of the striker 12 into and from the U-shaped groove 13C is possible by manual operation of the lower door. When the latch 13 is in the open state, the engaging piece 17 abuts against a stopper (not shown) and is arranged in a position allowing engagement to the latch 13.

The latch mechanism 14 includes a latch switch 21 (shown in FIG. 3 only) for detecting the positional state of the latch 13. The latch switch 21 includes a half latch switch 21*a* for detecting a half latch state, a full latch switch 21*b* for detecting a full latch state, and a courtesy switch 21*c* for turning on and off the courtesy lamp (not shown) that illuminates when the back door is opened.

Figure 10:
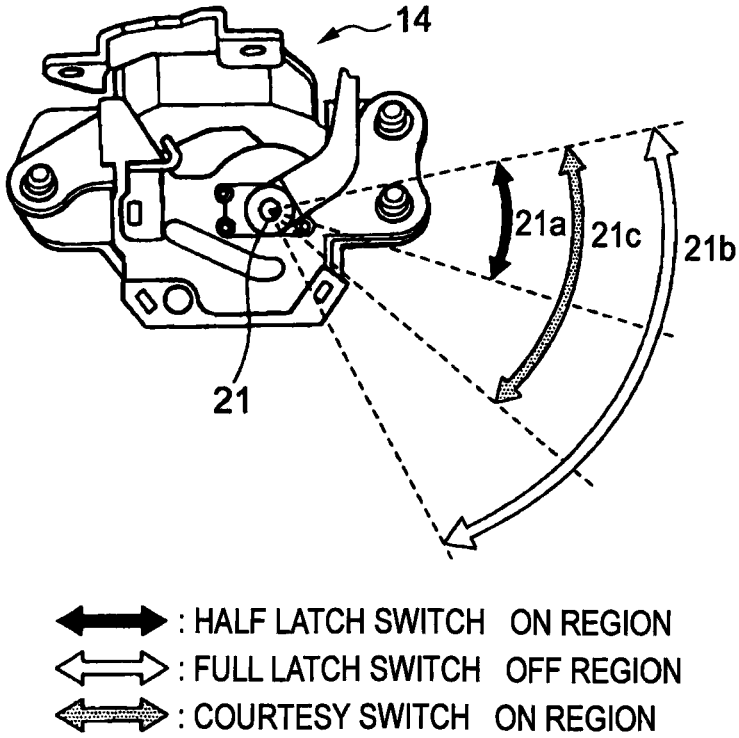
FIG. 10 It is an operation explanation drawing of the latch state detection switch of the door opening and closing device (first embodiment).

FIG. 10 shows the relationship of the on and off state range of the half latch switch 21*a*, the full latch switch 21*b* and the courtesy switch 21*c*.

To be more precise, the half latch switch 21*a* is turned off from the on state just before the latch 13 is set in the half latch state when the latch 13 is rotated from the open state to the closed state, and then the full latch switch is maintained off. The half latch switch 21*a* is turned on from the off state just after the latch 13 is set in the half latch state when the latch 13 is rotated from the closed state to the open state, and then the half latch switch is maintained on.

The full latch switch 21*b* is turned on from the off state at the point in time the latch 13 is set in the full latch state when the latch 13 is rotated from the open state to the closed state, and then the full latch switch is maintained on. The full latch switch 21*b* is turned off from the on state when the latch is no longer in the full latch state during rotation of the latch 13 from the closed state to the open state, and then the full latch switch is maintained off.

The courtesy switch 21*c* is turned off from the on state in a period of time from when the latch 13 is set in the half latch state to when the latch 13 is rotated from the open state to the closed state and is maintained off. The courtesy switch 21*c* is turned on from the off state just before the latch 13 is set in the half latch state when the latch 13 is rotated from the closed state to the open state and is maintained on.

The control unit 4 regard the time when the half latch switch 21*a* is turned off from the on state as the time when the latch 13 is just in a half latch state. And also, the control unit 4 regard the time when the full latch 21*b* switch turned on from the off state as the time when the latch is just in a full latch state.

The on and off output of the full latch switch 21*b* and the half latch switch 21*a* is made based on only the position of the latch 13 irrespective of whether the striker 12 is introduced into the U-shaped groove 13C of the latch 13.

The motor part 16 includes an output pinion gear 23 coupled to the motor 16*a* via a deceleration gear mechanism (not shown). The motor part 16 is designed to be driven by the control unit 4. The output pinion gear 23 is rotated in the forward or backward direction by the control unit 4. At the driving of the output pinion gear 23 in the motor part 16, an output drive force and an output drive speed in the forward and backward directions are equivalent.

The operation mechanism 15 includes an operation gear 24 driven by engaging with the output pinion gear 23. The operation gear 24 is rotatably supported by the gear spindle 25 not parallel to the latch spindle or engaging piece spindle 19. The operation gear 24 has an almost-fan-shaped in plane view and has a teeth part 24A engageable to the output pinion gear 23 on its arc portion. An operation pin 24*b* is fixedly mounted by caulking on the lateral surface of the operation gear 24. The position of the operation pin 24*b* on the operation gear 24 is at the one end of the peripheral direction and near the circumference of the operation gear 24.

On the gear spindle 25 is arranged a closing lever 26 in a rotatable state. The closing lever 26 rotates counterclockwise according to the counterclockwise rotation of the operation gear 24. This motion is realized by that an abutted part 16A of the closing lever 26 comes into contact with the operation pin 24B. Here, rotation direction is based on the description of FIG. 4.

Figure 4:
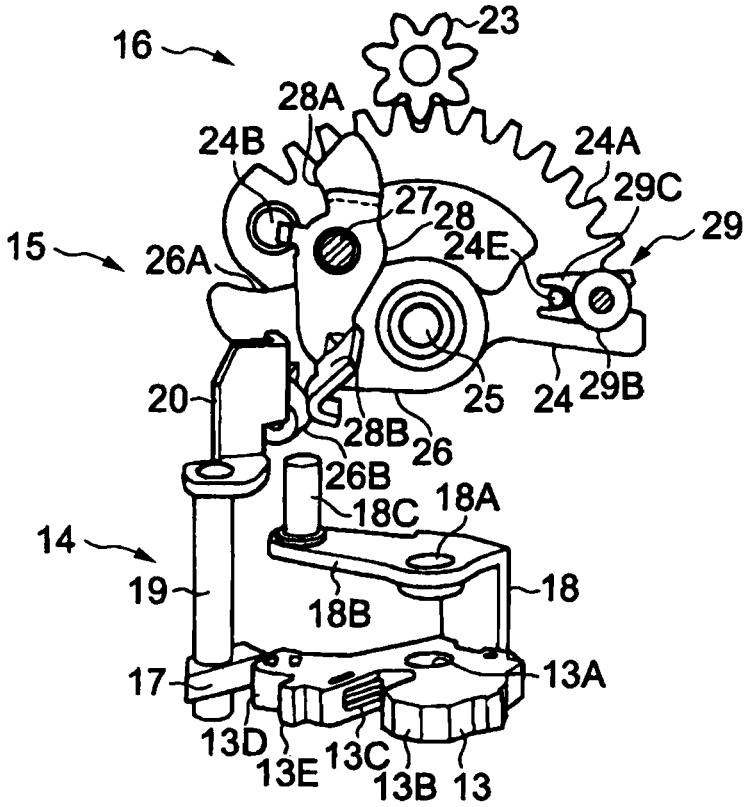
FIG. 4 It is a state explanation drawing of the key parts of the door opening and closing device with an operation gear almost in a neutral position (first embodiment).

The closing operation piece 26B of the closing lever 26 is designed to come into contact with the engaging pin 18C of the latch lever 18 based on the counterclockwise rotation of the operation gear 24 shown in FIG. 4. When the closing lever 26 further rotates in counterclockwise direction shown in FIG. 4 with the closing operation piece 26B in contact with the engaging pin 18C, the latch 13 rotates in the closing direction (direction of travel from the open state to the full latch state).

The closing lever 26 is tugged in clockwise direction shown in FIG. 4 by a spring (not shown). In a state where the closing lever 26 is not in contact with the operation pin 24B, the closing lever 26 abuts against a stopper (not shown) to be held in position.

The operation mechanism 15 includes an opening lever 28 rotatably supported by an opening lever spindle 27 parallel to the gear spindle 25, separate from the gear spindle 25, on the opposite side to the operation gear 24 interposing the closing lever 26. The abutted part 28A of the opening lever 28 comes into contact with the operation pin 24B to rotate clockwise based on the clockwise rotation of the operation gear 24 shown in FIG. 4.

The opening lever 28 includes an opening operation piece 28B designed to come into contact with the engaging piece lever 20 in a portion opposite to the abutted part 28A interposing the opening lever spindle 27. The opening operation piece 28B is designed to come into contact with engaging piece lever 20 based on the clockwise rotation of the opening lever 28 by the operation gear 24 shown in FIG. 4. When the opening lever 28 further rotates in clockwise direction shown in FIG. 4 with the opening operation piece 28B in contact with the engaging piece lever 20, the engaging piece 17 rotates in the direction to release engagement to the latch 13 (in counterclockwise direction in FIG. 4).

The opening lever 28 is tugged in counterclockwise direction shown in FIG. 4 by a spring 28C (shown in FIG. 3 only). In a state where it is not in contact with the operation pin 24B, the opening lever 28 abuts against a stopper (not shown) to be held in a predetermined position.

In the door opening and closing device 11, the control unit 4 controls the motor part 16 so as to cause the operation gear 24 to turn in the door full-close direction and the door full-close release direction by using the neutral position of the operation gear 24 as a reference. The neutral position is defined as a condition that the operation pin 24B and the levers 26, 28 do not abut against (interfere with) each other. A state where the operation gear 24 is inclined to the rotating direction for operating the closing lever 26 with respect to the neutral position (in counterclockwise direction in FIGS. 4 and 6 to 8) is referred as a state where the operation gear 24 is set near or on the door full-close side. A state where the operation gear 24 is inclined to the rotating direction side for operating the opening lever 28 with respect to the neutral position (in clockwise direction in FIGS. 4 and 6 to 8) is referred to as a state where the operation gear 24 is set near or at the door full-close release position.

When the operation gear 24 is in the neutral position, a predetermined spacing is provided between the operation pin 24B of the operation gear 24 and the abutted parts 26A, 28A of the levers 26, 28. When the operation gear 24 has rotated by a predetermined angle, the operation pin 24B and the abutted parts 26A, 28A abut against each other.

While the operation pin 24B and the levers 26, 28 do not interfere with each other, the levers 26, 28 are respectively held in the predetermined position so as not to interfere with the latch mechanism 14. In this state, it is possible to place the latch 13 in the half latch or full latch state by pressing the striker 12 introduced in the U-shaped groove 13C against the latch 13 based on the movement of the back door in the close direction by manual operation or the like.

In this embodiment, whether the operation gear 24 is positioned toward the door full-close side or door full-close release side is detected by the neutral switch 29 as a neutral position detecting sensor provided on the operation mechanism 15. The neutral switch 29 includes a rotor 29B rotatably supported on a base part 29A (shown in FIG. 3 only) fixed on the base of the operation mechanism 15. The rotor 29B includes thereon an engaging part 29C engageable to a sensor pin 24E provided on the operation gear 24. The neutral switch 29 detects the position of the operation gear according to the orientation of the sensor pin 24E because the orientation of the sensor pin 24E is changed by the rotation of the operation gear 24 with the engagement between the sensor pin 24E and the engaging part 29C.

Figure 6:
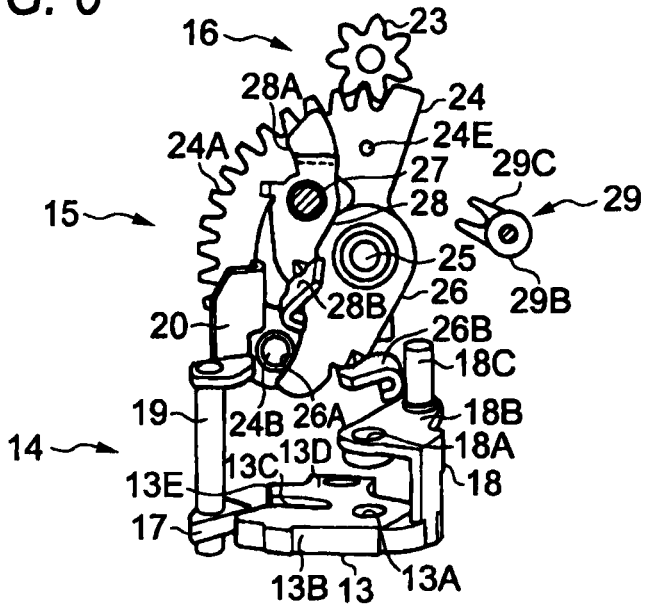
FIG. 6 It is an operation explanation drawing of the key parts of the door opening and closing device (first embodiment).
Figure 7:
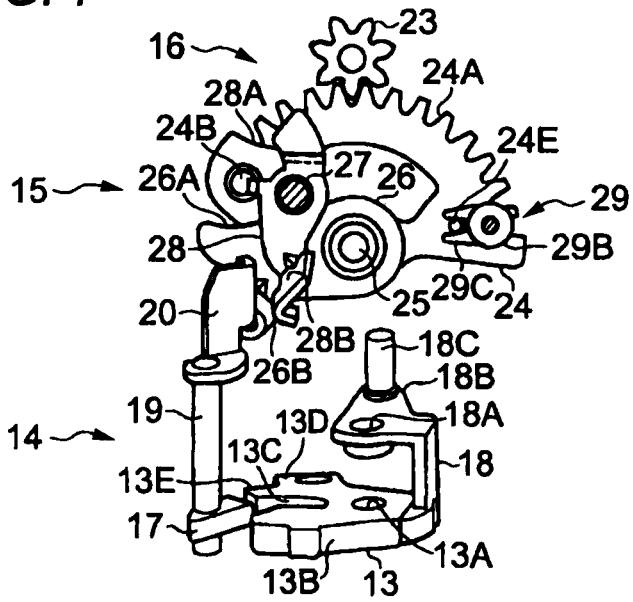
FIG. 7 It is an operation explanation drawing of the key parts of the door opening and closing device (first embodiment).
Figure 9:
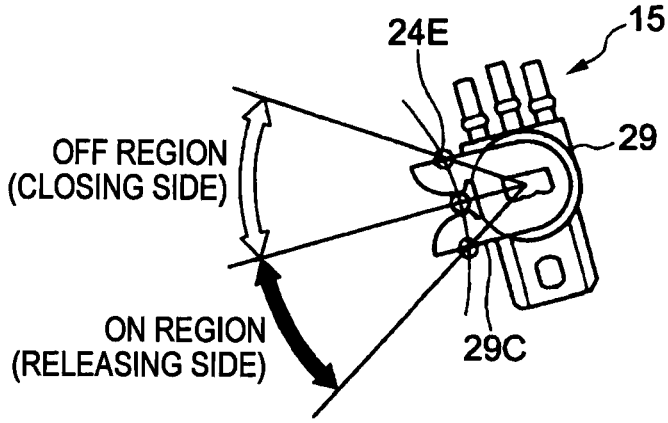
FIG. 9 It is an operation explanation drawing of the neutral switch of the door opening and closing device (first embodiment).

When the operation gear 24 is almost in the neutral position, the engaging part 29C is engaged to the sensor pin 24E (state of FIGS. 3 and 6). In a state where the operation gear 24 is positioned in the door full-close side, the rotor 29B is rotated so as to cause the engaging part 29C to be oriented upward (state of FIG. 5) and the neutral switch 29 outputs an off signal to the control unit 4 (neutral switch off state as a first state) (refer to FIG. 9). In a state where the operation gear 24 is positioned in the door full-close release position, the rotor 29B is rotated so as to cause the engaging part 29C to be oriented downward (state of FIG. 7) and the neutral switch 29 does not output an off signal to the control unit 4 (neutral switch on state as a second state) (refer to FIG. 9).

The control unit 4 regards a time when the state of the neutral switch 29 is changed between the ON state and the OFF state as a time when the operation gear 24 is in the neutral position. That is, the neutral switch 29 is designed to detect the neutral position based on the change between the ON state and the OFF state.

Further, the control unit 4 regards a time when the state of the neutral switch 29 has changed from the OFF state to the ON state as a time when the operation gear 24 is in the neutral position from the door full-close release side. The control unit 4 regards a time when the state of the neutral switch 29 has changed from the ON state to the OFF state as a time when the operation gear 24 is in the neutral position from the door full-close side.

In a state where the operation gear 24 is in the door full-close side or door full-close release side with the sensor pin 24E detached from the engaging part 29C, the orientation of the rotor 29B is held as it was detached, that is, in a state where the sensor pin 24E is engageable to the engaging part 29C again when the operation gear 24 rotates.

Figure 11:
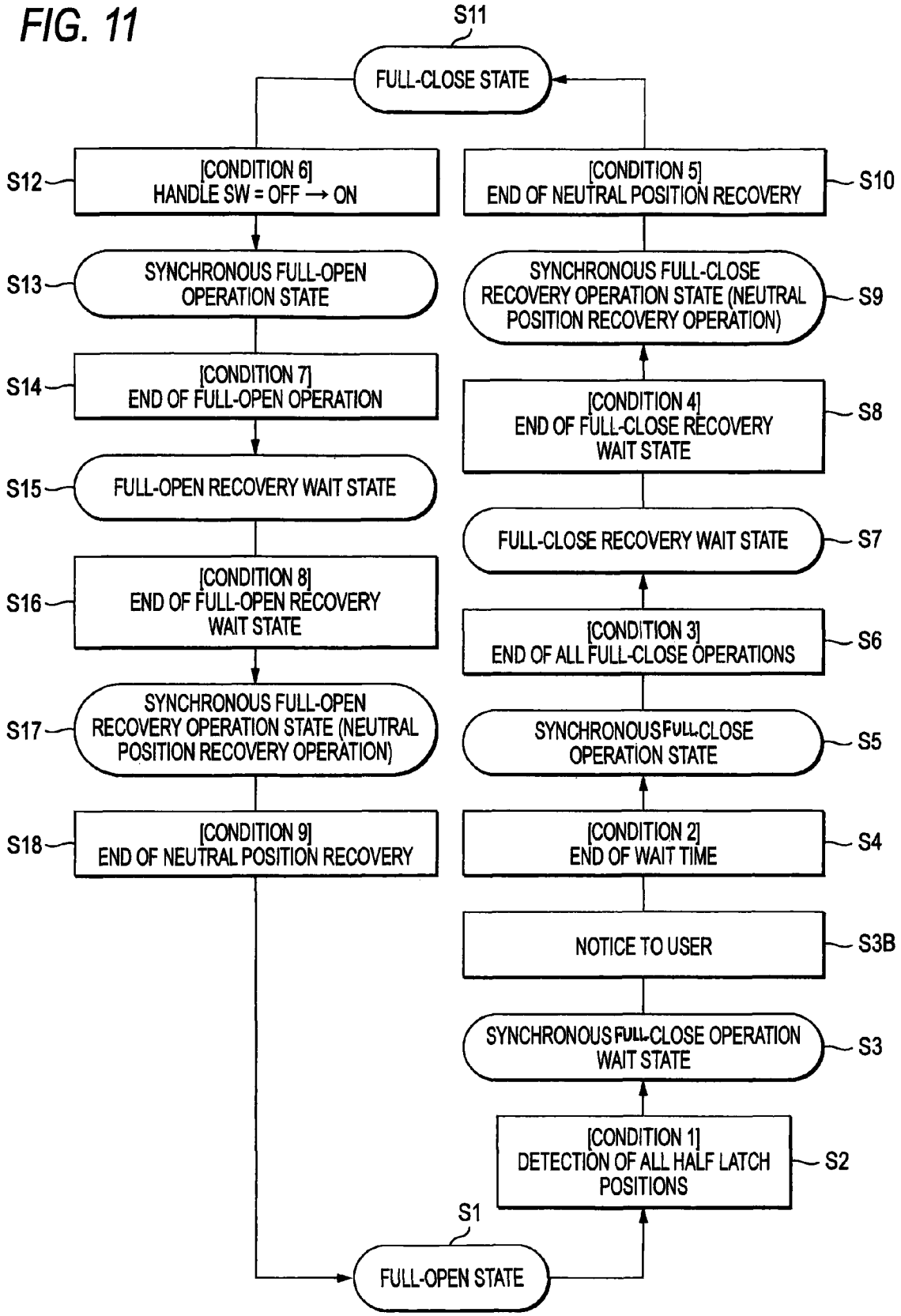
FIG. 11 It is a state transition diagram illustrating the operation of the vehicle door opening and closing system (first embodiment).
Figure 12B:
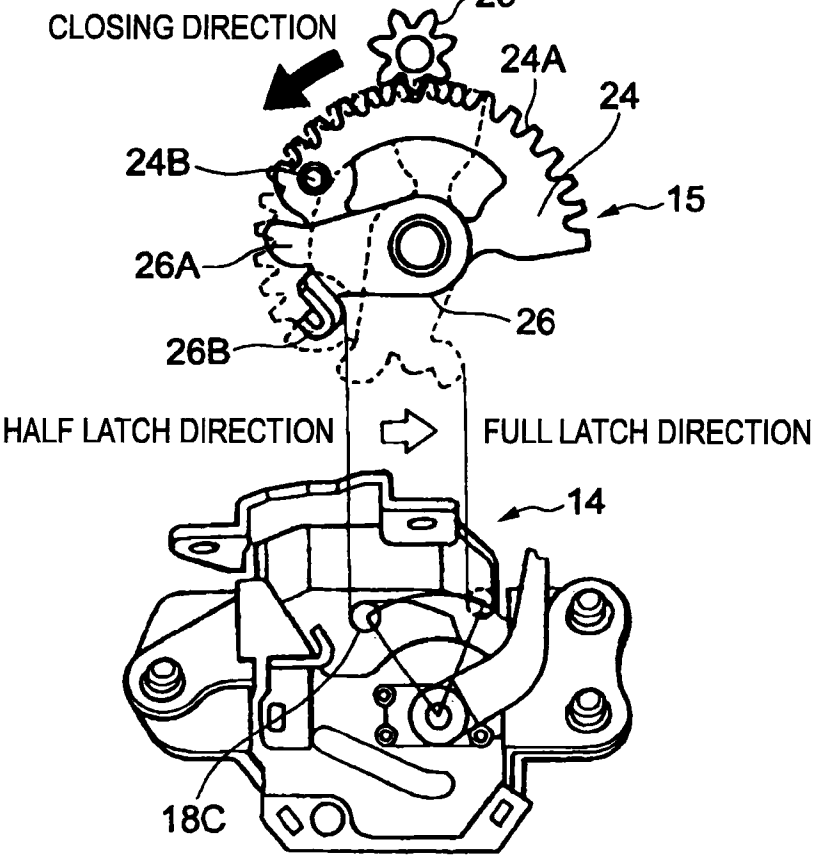
FIG. 12(B) It is an operation explanation drawing of the key parts of the door opening and closing device operating in the closing direction from a full-open state (first embodiment).
Figure 12A:
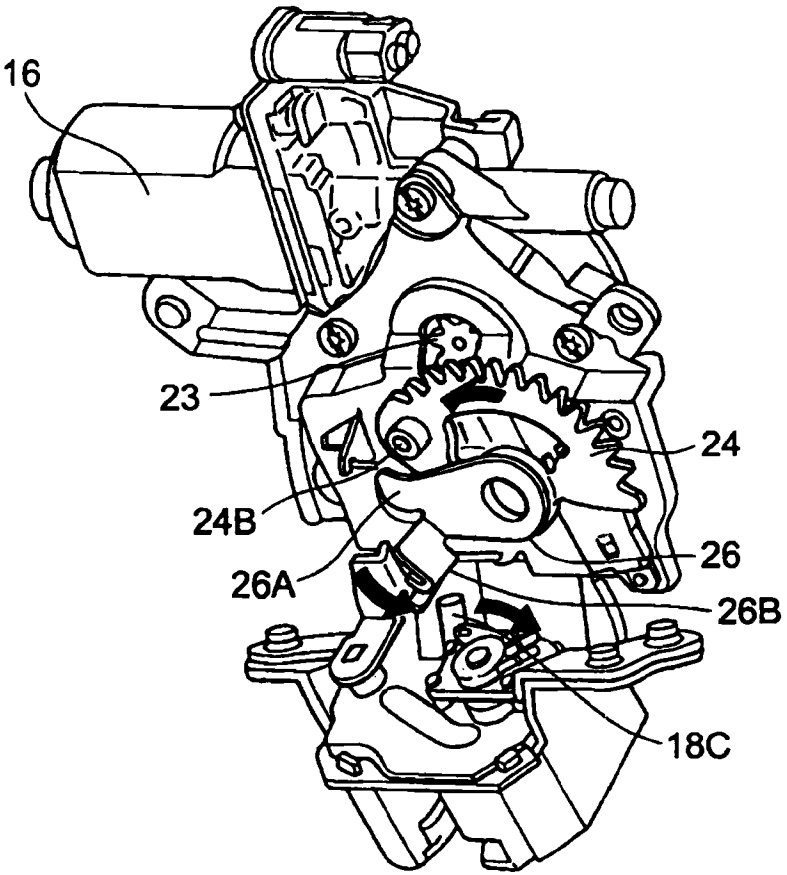
FIG. 12(A) It is an operation explanation drawing of the key parts of the door opening and closing device operating in the closing direction from a full-open state (first embodiment).
Figure 13B:
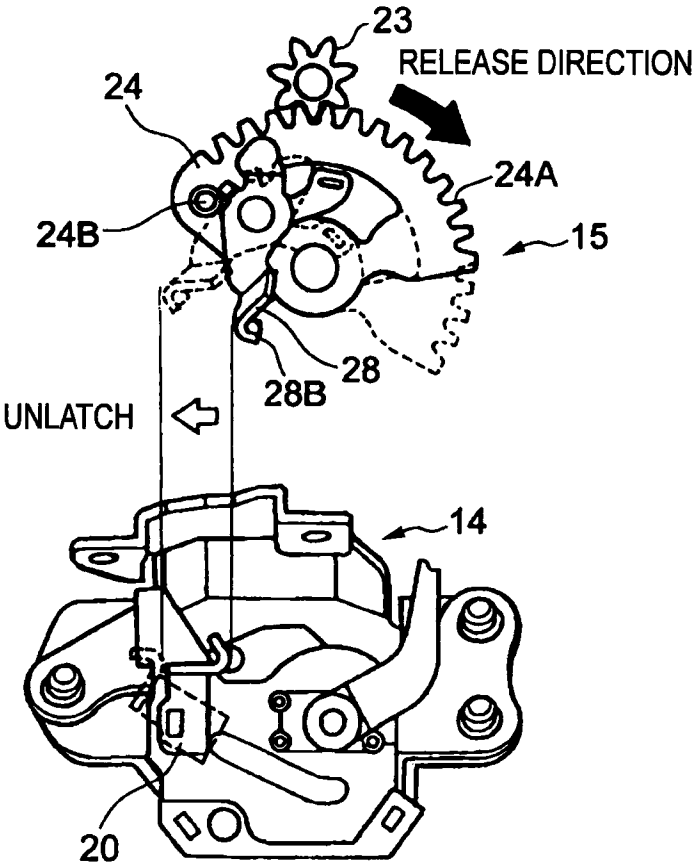
FIG. 13(B) It is an operation explanation drawing of the key parts of the door opening and closing device operating in the opening direction from a full-open state (first embodiment).
Figure 13A:
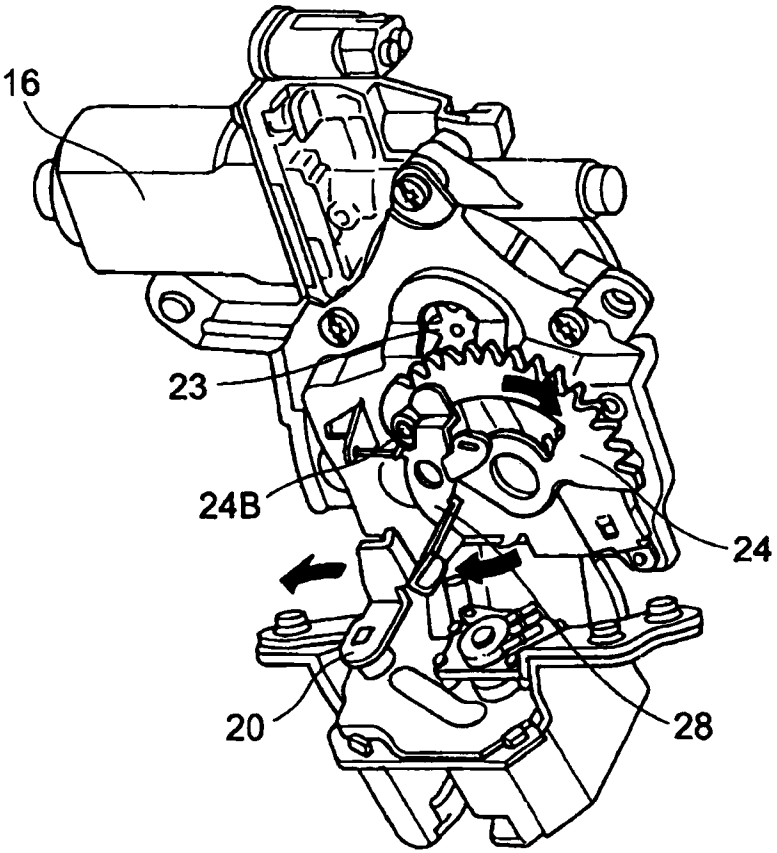
FIG. 13(A) It is an operation explanation drawing of the key parts of the door opening and closing device operating in the opening direction from a full-open state (first embodiment).
Figure 14:
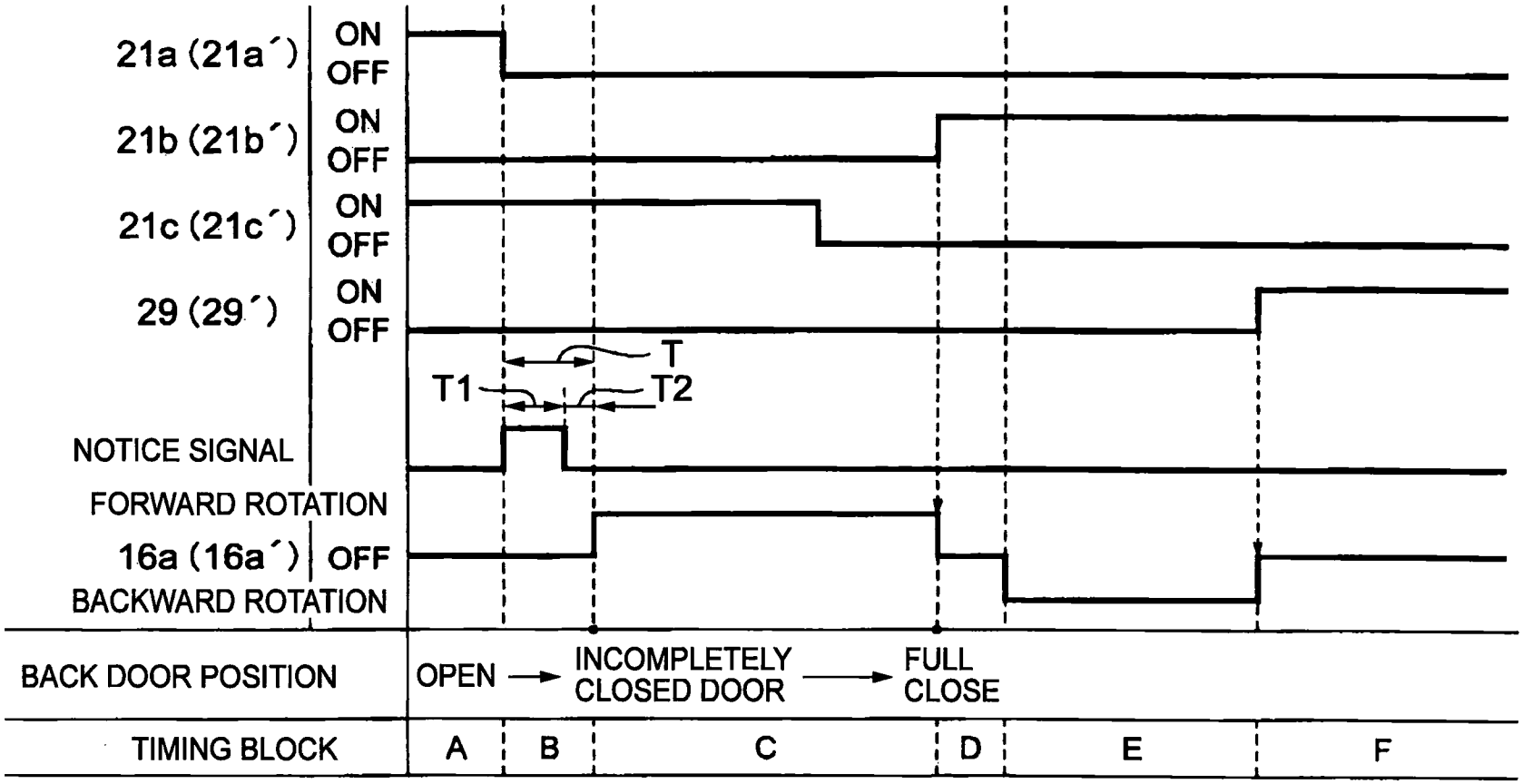
FIG. 14 It is a signal timing chart of the key parts of the door opening and closing device operating in the closing direction from a full-open state (first embodiment).
Figure 15:
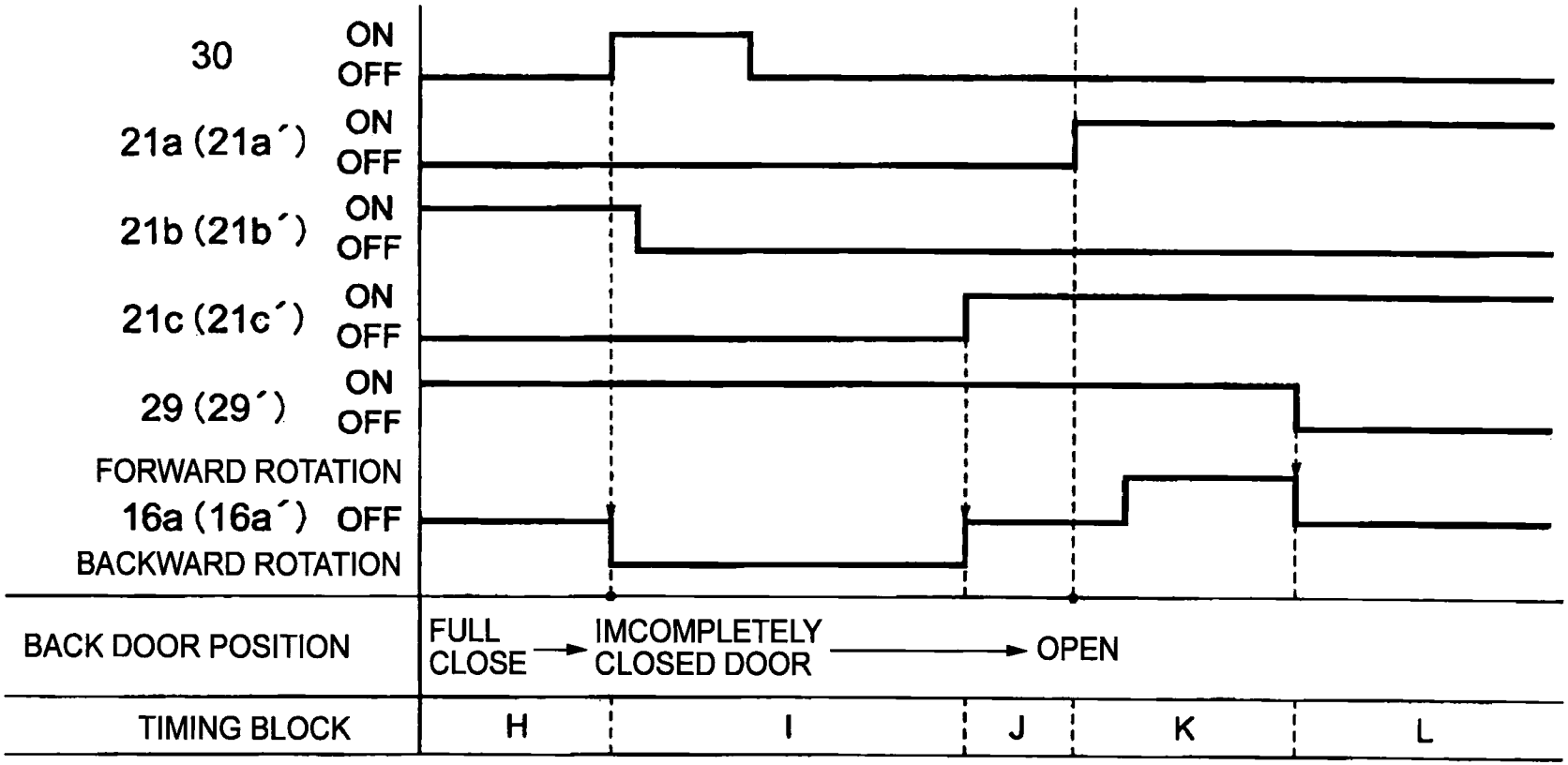
FIG. 15 It is a signal timing chart of the key parts of the door opening and closing device operating in the closing direction from a full-close state (first embodiment).

Next, operation of the vehicle door opening and closing system having the above configuration is described referring to FIGS. 11 to 15. FIG. 11 is a state transition diagram of the vehicle door opening and closing system according to this embodiment. FIGS. 12A and 12B are operation explanation drawings of the key parts of the door opening and closing device operating in the closing direction from a full-open state. FIGS. 13A and 13B are operation explanation drawings of the key parts of the door opening and closing device operating in the opening direction from a full-close state. FIG. 14 is a signal timing chart of the key parts of the door opening and closing device operating in the closing direction from a full-open state. FIG. 15 is a signal timing chart of the key parts of the door opening and closing device operating in the closing direction from a full-close state.

First, operation to open the lower door 3 of the back door in a full-close state from a full-open state is described. In case the lower door 3 of the back door is in a full-open state (step S1 in FIG. 11) (timing block A in FIG. 14), the latch 13 (13') is in the open state and the operation gear 24 (24') is almost in a neutral state.

In this state, the half latch switch 21*a* (21*a'*) of the latch switch 21 (21') is in the ON state, the full latch switch 21*b* (21*b'*) is in the OFF state, and the courtesy switch 21*c* (21*c'*) is in the ON state. The operation gear 24 (24') is slightly inclined to the door full-close side and the neutral switch 29 is in the OFF state.

In this state, when the user manually moves the lower door 3 in the closing direction and the latch 13 (13') is rotated in the closing direction by the striker 12 (12') introduced in the U-shaped groove 13C (13C'), the latch 13 (13') is set in a half latch state shown in FIG. 5 with the first engaging protrusion 13D (13D') and the engaging piece 17 (17') engaged to each other.

When both the half latch switch 21*a* of the door opening and closing device 11 and the half latch switch 21*a'* of the door opening and closing device 11' have been placed in an OFF position from an ON position, the determination part 5*a* of the control unit 4 regards that the latches of all the door opening and closing devices are placed in the half latch state (step S2) and execution proceeds to step S3. In other words, in step S2, detection of half latch position of all the door opening and closing devices is assumed as Condition 1 and in case Condition 1 is satisfied, execution may proceed to next step. Thus, when the half latch state is detected for one of the two door opening and closing devices 11, 11' and the half latch state is not detected for the other, execution does not proceed to next step. Only when the half latch positions are detected for both of the two door opening and closing devices 11 and 11', execution proceeds to next step.

When Condition 1 is satisfied, the controller 5*b* of the control unit 4 places the door opening and closing devices 11 and 11' in a synchronous full-close operation wait state for making an instruction to start driving of the motor in the door opening and closing devices 11 and 11' and waits for a predetermined wait time T from the instruction to start driving (step S3) (timing block B in FIG. 14).

Next, during the wait time T, the controller 5*b* performs driving control of a sound output circuit 41 to supply a notice signal to a loudspeaker 42 for a notice time T1 and issues a notice to the user from the loudspeaker 42 by way of a buzzer tone or a voice message (step S3B). This notice is to inform the user of start of synchronous full-close operation by a motor (described later) to alert the user. The notice time T1 is set to a time long enough for the user to recognize the notice. The time T2 (=T−T1) from the end of the notice time T1 to the end of the wait time T is set as a recognition time long enough for the user to recognize the end of the notice. The wait time T is set to the time from when the half latch positions are detected for both of the two door opening and closing devices 11, 11' to when the synchronous full-close operation is started, which time is reasonable to the user.

Next, when the determination part 5*a* recognizes the end of the wait time T (Condition 2) (step S4), the controller 5*b* sets the door opening and closing devices 11 and 11' in a synchronous full-close operation state (step S5) (timing block C in FIG. 14). The controller 5*b* starts synchronous forward driving of the motors 16*a* and 16*a'* of the door opening and closing devices 11 and 11'.

As shown in FIG. 12, the operation gear 24 (24') starts to rotate counterclockwise. When the angle of rotation has reached a predetermined angle, the operation pin 24B (24B') abuts against the abutted part 26A (26A') of the closing lever 26 (26'), which causes the closing lever 26 (26') to start rotating.

When the rotation angle of the closing lever 26 (26') has reached a predetermined angle and is further rotated, the latch 13 (13') is rotated toward the full latch position with the closing operation piece 26B (26B') in contact with the engaging pin 18C (18C'). When the closing operation piece 26B (26B') is rotated to the position indicated by the dotted line in FIG. 12(B), the engaging pin 18 C (18C') is rotated to the position indicated by the dotted line (state of FIG. 6). As a result, the striker 12 (12') (not shown in FIG. 6) is drawn by the rotation of the latch 13 (13') so that the lower door 3 is in a full-close state. The state of the courtesy switch 21*c* (21*c'*) changes from the ON state to the OFF state during rotation of the latch 13 (13').

When the latch 13 (13') reaches a position beyond the full latch state capable of holding the lower door 3 in a full-close state, the state of the full latch switch 21*b* (21*b'*) changes from the OFF state to the ON state. The motor 16*a* (16*a'*) of the motor part 16 (16') drives the latch 13 (13') to rotate until the full latch switch 21*b* (21*b'*) is in the ON state. This secures engagement between the second engaging protrusion 13E (13E') and the engaging piece 17 (17'). When the determination part 5*a* detects that the full latch switch 21*b* (21*b'*) is in the ON state, the controller 5*b* accordingly makes control to shut down the motor 16*a* (16*a'*). That is, the controller 5*b* asynchronously stops the motor 16 and the motor 16' driving.

When both of the full latch switch 21*b* of the door opening and closing device 11 and the full latch switch 21*b'* of the door opening and closing device 11' have changed over from the OFF state to the ON state, the determination part 5*a* of the control unit 4 regards that the latches 13 of all the door opening and closing devices are placed in the full latch position and all full-close operations are completed (Condition 3) (step S6). Execution proceeds to next step.

Next, the controller 5*b* of the control unit 4 places the door opening and closing devices 11 and 11' in a full-close recovery wait state and waits for a predetermined time (for example 0.3 seconds) (step S7) (timing block D in FIG. 14).

Next, when the determination part 5*a* recognizes the end of the full-close recovery wait time (Condition 4) (step S8), the controller 5*b* sets the door opening and closing devices 11 and 11' in a synchronous full-close recovery operation (neutral position return operation) state (step S9) (timing block E in FIG. 14). The controller 5*b* starts synchronous backward driving of the motors 16*a* and 16*a'* of the door opening and closing devices 11 and 11'. This secures engagement between the second engaging protrusion 13E (13E') and the engaging piece 17 (17'). The latch 13 (13') is set in the full latch state and engagement between the closing operation piece 26B (26B') and the engaging pin 18C (18C') is released and a stress excessively exerted on the latch mechanism 14 (14') and the operation mechanism 15 (15') is relaxed (state of FIG. 7).

When the operation gear 24 (24') starts to rotate clockwise by the backward driving of the motor 16*a* (16*a'*) and is turned to reach the neutral position, the neutral switch 29 (29') changes from the OFF state to the ON state. The change of the state of the neutral switch 29 (29') is communicated to the determination part 5*a*.

The determination part 5*a* recognizes the change of the neutral switch 29 (29') as the end of neutral position recovery (Condition 5) where the operation gear 24 (24') has reached the neutral position. At this time, the controller 5*b* shut down the motor 16*a* (16*a'*) (step S10). Due to the time lag of control by the controller 5*b* and the mechanical inertia of the motor part 16 (16') and the operation gear 24 (24'), the operation gear 24 (24') stops in a position that is slightly beyond the neutral position. In this state, the operation gear 24 (24') is slightly inclined to the door full-close release side with respect to the neutral position. In the position slightly beyond the neutral position, even in case the operation pin 24B (24B') is in contact with the abutted part 28A (28A') of the opening lever 28 (28'), the opening operation piece 28B (28B') does not yet interfere with the engaging piece lever 20 (20') so that the engaging piece 17 (17') is not brought into opening operation.

This state is a full-close state where the lower door 3 is fully closed (step S11) (timing block F in FIG. 14).

Operation to place the lower door 3 of the back door in a full-open state from a full-close state will be described. In case the lower door 3 of the back door is in a full-close state (step S11 in FIG. 11) (timing block H in FIG. 15), the latch 13 (13') is in the closed state and the operation gear 24 (24') is almost in a neutral state.

In this state, the half latch switch 21*a* (21*a'*) of the latch switch 21 (21') is in the OFF state, the full latch switch 21*b* (21*b'*) is in the OFF state, and the courtesy switch 21*c* (21*c'*) is in the OFF state. The operation gear 24 (24') is in slightly toward the door full-open side with respect to the neutral position and the neutral switch 29 is in the ON state.

In this state, when the handle switch button 30*a* is pressed by the user to set the lower door 3 in the full-close release state (open state) and the handle switch 30 changes from the OFF state to the ON state (Condition 6 in step S12), the controller 5*b* instructs the motor driving circuits 9 and 10 to start synchronous driving control of the motors 16*a* and 16*a'* for releasing the full-close state of the door opening and closing devices 11 and 11' to place the same in the synchronous full-open operation state (step S13) (timing block I in FIG. 15). The controller 5*b* starts synchronous backward driving of the motors 16*a* and 16*a'* of the door opening and closing devices 11 and 11'.

As shown in FIG. 13, the operation gear 24 (24') starts to rotate clockwise. When the angle of rotation has reached a predetermined angle, the operation pin 24B (24B') abuts against the abutted part 28A (28A') of the opening lever 28 (28'), which causes the opening lever 28 (28') to start rotating.

When the rotation angle of the opening lever 28 (28') has reached a predetermined angle and is further rotated, the engaging piece 17 (17') is rotated in the engagement release direction with the latch 13 (13') in the state that the opening operation piece 28B (28B') abuts against the engaging piece lever 20 (20'). When the opening operation piece 28B (28B') is rotated to the position indicated by the dotted line in FIG. 13(B), the engaging piece lever 20 (20') is rotated to the position indicated by the dotted line (state of FIG. 8). As a result, the engagement between the engaging piece 17 (17') and the latch 13 (13') is released and the latch 13 (13') is rotated toward the open state side with a restoring force by the spring. As a result, it is possible to draw the striker 12 (12') out of the U-shaped groove 13C (13C') and place the lower door 3 in the full-close release state.

When the latch 13 (13') is rotated from the full latch state side to the open state side, the full latch switch 21*b* (21*b'*) changes from the OFF state to the ON state, the courtesy switch 21*c* (21*c'*) changes from the OFF state to the ON state, and finally the half latch switch 21*a* (21*a'*) changes from the OFF state to the ON state during the rotation. When the determination part 5*a* detects that the courtesy switch 21*c* (21*c'*) changes to the ON state, the controller 5*b* accordingly makes control to shut down the motor 16*a* (16*a'*). That is, the controller 5*b* asynchronously stops the motor 16 and the motor 16' driving.

When both the courtesy switch 21*c* of the door opening and closing device 11 and the courtesy switch 21*c'* of the door opening and closing device 11' changes from the OFF state to the ON state, the determination part 5*a* regards that the latches 13 of all the door opening and closing devices are in the open state and all full-close operations are complete with the lower door 3 movable in the open direction manually or the like (Condition 7) (step S14). Execution proceeds to next step.

Next, the controller 5*b* places the door opening and closing devices 11 and 11' in a full-open recovery wait state and waits for a predetermined time (for example 0.3 seconds) (step S15) (timing block J in FIG. 15).

Next, when the determination part 5*a* recognizes the end of the full-open recovery wait time (Condition 8) (step S16), the controller 5*b* sets the door opening and closing devices 11 and 11' in a synchronous full-open recovery operation (neutral position return operation) state (step S17) (timing block K in FIG. 15). The controller 5*b* starts synchronous forward driving of the motors 16*a* and 16*a'* of the door opening and closing devices 11 and 11'.

When the operation gear 24 (24') starts to rotate counterclockwise by the forward driving of the motor 16*a* (16*a'*) and is turned to reach the neutral position, the neutral switch 29 (29') changes from the ON state to the OFF state. The change of the state of the neutral switch 29 (29') is communicated to the determination part 5*a*.

The determination part 5*a* regards the change of the neutral switch as the end of neutral position recovery where the operation gear 24 (24') has reached the neutral position (Condition 9). The controller 5*b* accordingly shuts down the motor 16*a* (16*a*') (step S18). Due to the time lag of control by the controller 5*b* and the mechanical inertia of the motor part 16 (16') and the operation gear 24 (24'), the operation gear 24 (24') stops in a position that is slightly beyond the neutral position. In this state, the operation gear 24 (24') is slightly inclined to the door full-open side with respect to the neutral position. In the position slightly beyond the neutral position, even in case the operation pin 24B (24B') is in contact with the abutted part 26A (26A') of the closing lever 26 (26'), the closing operation piece 26B (26B') does not interfere with the engaging pin 18C (18C') so that the latch 13 is not brought into opening operation.

This state is a full-open state where the all operations of the door opening and closing device 11 (11') to the full-open side is completed. At this time, it is possible to move the lower door 3 in the opening direction manually, and execution has returned to step S1 (timing block L in FIG. 15).

As described above, according to the first embodiment of the invention, it is possible to make, readily and reliably, the automatic opening and closing control of the back door by using a plurality of motors thus reducing the burden of load on the user as well as eliminating half-fitting of the door (so-called incompletely closed door) and enhancing the operability and convenience. The user is informed of the start of operation before automatic opening and closing of the door is started. This prevents possible pinching and secures the safety of the user. Time setting is made from the notice to the start of motor driving so that the wait time will include a notice time for issuing a notice signal at the start of motor driving and a recognition time for letting the user recognize the end of notice after the end of the notice time. The user is aware of a sense of time, which helps implement a safer system.

During control of the back door from the open state to the closed state, full-close operation is not started until all of the plurality of door opening and closing devices are placed in the half latch state. This prevents possible pinching of the user as a cause of an incompletely closed door thus offering the safety of the user and preventing a fault in a vehicle or deformation of a vehicle caused by pinching of a foreign object. A plurality of motors arranged in separate locations of the back door is subjected to synchronous driving control. This offers a smooth operation similar to control of a single motor and provides a sense of high quality and upscale image without giving a sense of incongruity to the user. The plurality of motors is subjected to simultaneous driving control. This prevents asynchronous motor operation sounds, prolonged control time and provides a silent operation. Therefore a high-quality vehicle door opening and closing system is provided.

Second Embodiment

Figure 8:
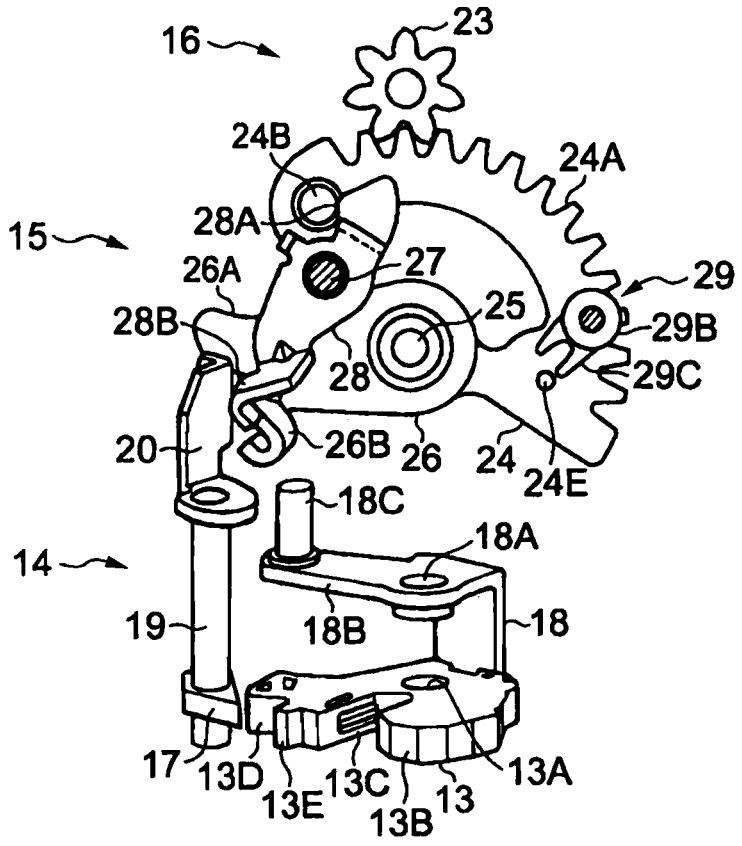
FIG. 8 It is an operation explanation drawing of the key parts of the door opening and closing device (first embodiment).
Figure 16:
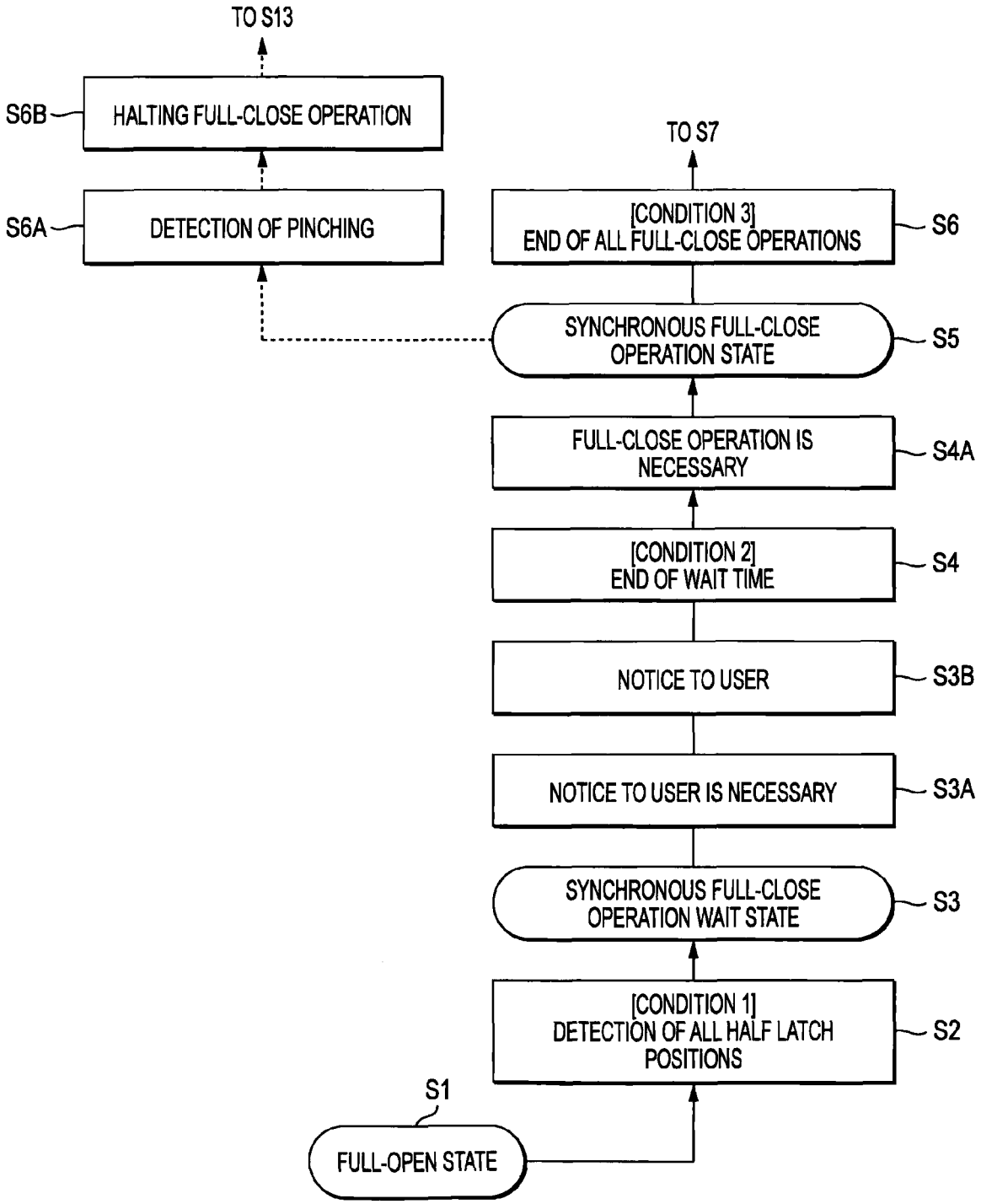
FIG. 16 It is a state transition diagram illustrating the operation of a vehicle door opening and closing system according to the second embodiment of the invention (second embodiment).
Figure 17A:
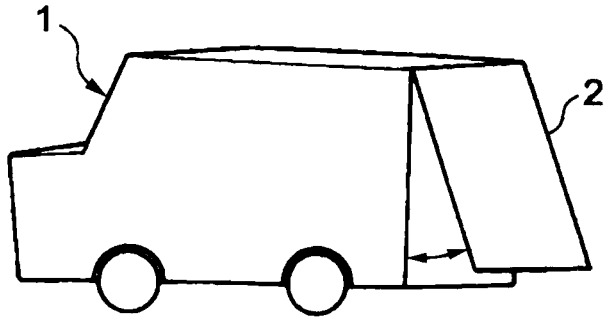
FIG. 17(A) It illustrates a back door opening and closing system of a vehicle in the related art (related art).
Figure 17B:
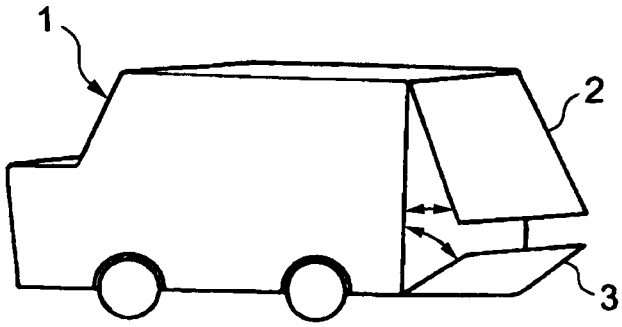
FIG. 17(B) It illustrates a back door opening and closing system of a vehicle in the related art (related art).
Figure 18:
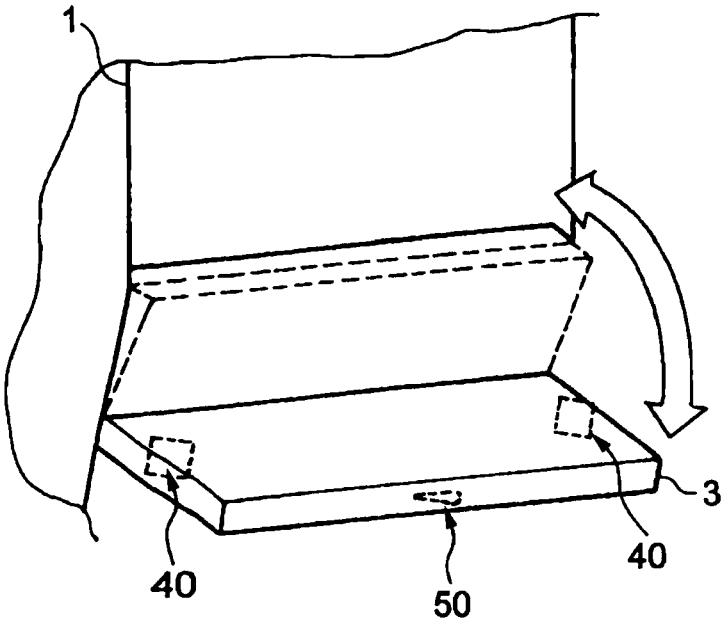
FIG. 18 It illustrates the arrangement of a lock mechanism in the opening and closing system of FIG. 16(B) (related art).

Next, the second embodiment of the invention is described referring to the state transition diagram of FIG. 16. The second embodiment is the same as the first embodiment except in that the states of steps S3 to S6 in the state transition diagram of the first embodiment shown in FIG. 8 are different.

As shown in FIG. 16, in step S3, the controller 5*b* sets the door opening and closing devices 11 and 11' in the synchronous full-close operation wait state and waits for a predetermined time T. When the determination part 5*a* determines that it is necessary to inform the user (step S3A), during the wait time T, the controller 5*b* performs driving control of a sound output circuit 41 to supply a notice signal to a loudspeaker 42 for a notice time T1 and issues a notice to the user from the loudspeaker 42 by way of a buzzer tone or a voice message (step S3B).

Determination in step S3A is made by monitoring the time required from when both half latch switches 21*a* and 21*a*' of the door opening and closing devices 11 and 11' are in the OFF state to when both full latch switches 21*b* and 21*b*' are placed in the ON state. That is, while the time required from the half latch position to the full latch position in automatic closing operation by a motor is almost constant, the time required from the half latch position to the full latch position is shorter than the time required in automatic closing operation by a motor in case the user manually pushes the back door into the full latch position.

Thus, a notice determination time threshold value is previously set which is slightly shorter than the time required for normal automatic closing operation by a motor. The time required from the half latch position to the full latch position is monitored by the determination part 5*a* to determine whether a notice to the user is necessary or not. Unless the time required is shorter than the notice determination time threshold value, it is determined that a notice to the user is necessary and execution proceeds to next step S3B. In case the time required is shorter than the notice determination time threshold value, it is determined that manual closing operation is made and a notice to the user is unnecessary, and no further closing operation follows.

Next, the determination part 5*a* determines the end of the wait time T (Condition 2) (step S4) and then determines the necessity of full-close operation (step S4A). In this determination step, in case it is determined that a notice to the user is unnecessary in step S3A (in case the full latch state is manually activated), in case the full-close state changes to the full-open state due to rebound or inclination of the lower door 3, or while the notification is provided to the user, full-close operation is determined unnecessary, and otherwise, full-close operation is determined necessary.

When full-close operation is determined unnecessary, the controller 5*b* set the door opening and closing device 11 and 11' in the synchronous close operation state (step S5) (timing block C in FIG. 14). That is, the controller 5*b* starts synchronous forward driving of the motors 16*a* and 16*a*' of the door opening and closing devices 11 and 11'.

When both the full latch switch 21*b* of the door opening and closing device 11 and the full latch switch 21*b*' of the door opening and closing device 11' changes from the OFF state to the ON state, the determination part 5*a* of the control unit 4 regards that the latches 13 of all the door opening and closing devices are set in the full latch position and all full-close operations are completed (Condition 3) (step S6). Execution proceeds to next step.

When the determination part 5*a* determines that pinching is detected during synchronous full-close operation (step S6A), the controller 5*b* stops driving of the motors 16*a* and 16*a*' of the door opening and closing devices 11 and 11' and halts full-close operation (step S6B). In this case, execution proceeds to step S13 and steps S13 to S18 are followed to return the lower door 3 to the full-open state.

Determination of pinching is made by monitoring the time required from when both half latch switches 21*a* and 21*a*' of the door opening and closing devices 11 and 11' are set in the OFF state to when both full latch switches 21*b* and 21*b*' are set in the ON state. That is, while the time required from the half latch position to the full latch position in automatic closing operation by a motor is almost constant, the time required from the half latch position to the full latch position is longer than the time required in automatic closing operation by a motor in case a person or an object is pinched by a door.

Thus, a pinching determination time threshold value is previously set which is slightly longer than the time required for normal automatic closing operation by a motor. The time required from the half latch position to the full latch position is monitored by the determination part 5*a* to determine whether pinching has occurred or not. In case the time required is longer than the pinching determination time threshold value, it is determined that pinching has occurred and execution proceeds to next step S6B. Unless the time required is longer than the pinching determination time threshold value, it is determined that pinching does not occur and steps S6, S7 and the subsequent steps are followed.

In this way, according to the second embodiment of the invention, the user is informed of the start of operation before the automatic door opening and closing operation is started. In case the user or a foreign object should be pinched afterwards, the full-close operation is stopped and the full-open state is recovered. This assures the safety of the user and prevents a fault in a vehicle or deformation of a vehicle.

While the embodiments of the invention have been described, the invention is not limited thereto but may be subjected to various modifications or applications.

While the announcing mechanism includes a sound output circuit 41 and a loudspeaker 42 in the foregoing embodiments, the invention is not limited thereto and an announcing mechanism using blinking of light by way of a tail lamp or the like may be used instead or additionally. The buzzer tone or blinking of light may be time-varying so that the passage (end) of the notice time may be recognized.

While the system according to the foregoing embodiments includes a plurality of door opening and closing devices, the invention is not limited thereto but is applicable to, for example, a single-motor-based automatic door opening and closing system including a door opening and closing device arranged near a handle button 30*a*. In such a case, when the vehicle door is set in a closed state from an open state, a control unit makes control to issue an instruction to drive the single motor when detecting that a latch switch is in a half latch state. When a predetermined wait time T has elapsed since the driving start instruction, the control unit makes control to start driving of the single motor and cause the latch mechanism to change over from a half latch state to a full latch state and issue a notice signal to inform start of driving from a loudspeaker during the wait time T.

While a striker is arranged on the vehicle body and a door opening and closing device is arranged on the vehicle door in the foregoing embodiments, a striker may be arranged on the vehicle door and a door opening and closing device may be arranged on the vehicle body.

While the above embodiments are used for opening and closing control of a lower door of a back door comprises a flip-up type upper door and a flip-down type lower door, the invention is not limited thereto but is applicable to any door of a vehicle as long as a single motor or a plurality of motors are used to perform automatic opening and closing of a door.

What is claimed is:

1. A door opening and closing system in a vehicle, comprising:

a door opening and closing device including:

a latch mechanism configured to make a door of a vehicle into a full latch state and a half latch state;

a motor configured to drive the latch mechanism so as to open or close the door; and a latch switch configured to detect the states of the door;

a controller configured to:

generate an instruction when the half latch state is detected by the latch switch; and after, the instruction is generated, delay providing the instruction to the motor until a predetermined notice time, associated with a time for issuing a notice signal at the start of motor driving, and a subsequent predetermined recognition time, associated with a time for letting a user recognize the end of notice, elapse; and an announce mechanism configured to provide a signal indicative of a starting of the driving of the motor, to a user during the predetermined notice time in response to the instruction from the controller, wherein the motor drives the latch mechanism to make the door move from the half latch state to the full latch state after the notice time and the subsequent predetermined recognition time elapse from when the instruction is generated, and wherein a predetermined notice determination time threshold value, associated with a time required for normal automatic closing operation by the motor, is installed in the controller, and the controller stops the motor driving if the notice determination time threshold value is smaller than a time from the half latch state to full latch state.

2. The door opening and closing system according to claim 1 further comprising a plurality of the door opening and closing devices.

3. A method of opening and closing a door of a vehicle by a door opening and closing device, which includes a latch mechanism configured to make a door of the vehicle into a full latch state from a half latch state; a motor configured to drive the latch mechanism so as to open or close the door; and a latch switch configured to detect the states of the door, the method comprising:

detecting the state of the door;

generating an instruction when the half latch state is detected;

after generating the instruction, delay providing the instruction to the motor until a predetermined notice time, associated with a time for issuing a notice signal at the start of motor driving, and a subsequent predetermined recognition time, associated with a time for letting a user recognize the end of notice, elapse;

providing a signal indicative of a starting of the driving of the motor, to a user during the predetermined notice time in response to the instruction; and driving the latch mechanism to make the door from the half latch state to the full latch state after the notice time and the subsequent predetermined recognition time elapse from when the instruction is generated, and stopping the motor driving if a predetermined notice determination time threshold value, associated with a time required for normal automatic closing operation by the motor, is smaller than a time from the half latch state to full latch state.

4. The method of claim 3, further comprising:

the recognition time is set so as to have a duration sufficient to enable the user to recognize the signal.

* * * * *

UNITED STATES PATENT AND TRADEMARK OFFICE

CERTIFICATE OF CORRECTION

PATENT NO. : 8,864,187 B2
APPLICATION NO. : 12/343077
DATED : October 21, 2014
INVENTOR(S) : Norifumi Jitsuishi et al.

It is certified that error appears in the above-identified patent and that said Letters Patent is hereby corrected as shown below:

On the Title page, item 57, abstract, line 3, "The inventive is" should read --The invention is--.

Signed and Sealed this
Twenty-second Day of September, 2015

Michelle K. Lee

Michelle K. Lee
*Director of the United States Patent and Trademark Office*